US006648276B1

(12) United States Patent
McQuistian

(10) Patent No.: US 6,648,276 B1
(45) Date of Patent: Nov. 18, 2003

(54) DROP DOWN LUG FOR RAILROAD SWITCH APPLICATION

(75) Inventor: Kevin M. McQuistian, Export, PA (US)

(73) Assignee: Union Switch & Signal, Inc., Pittsburgh, PA (US)

( * ) Notice: Subject to any disclaimer, the term of this patent is extended or adjusted under 35 U.S.C. 154(b) by 0 days.

(21) Appl. No.: 10/135,858

(22) Filed: Apr. 30, 2002

(51) Int. Cl.[7] ..... E01B 7/00

(52) U.S. Cl. ..... 246/452; 246/393; 246/407

(58) Field of Search ..... 246/404, 407, 246/410, 411, 393, 412, 413, 452, 449, 415 R; 74/579 R; 403/62, 68, 65, 125

(56) References Cited

U.S. PATENT DOCUMENTS

| | | | | | |
|---|---|---|---|---|---|
| 275,336 | A | * | 4/1883 | Harper | 246/411 |
| 488,182 | A | * | 12/1892 | Christiansen | 246/406 |
| 654,274 | A | * | 7/1900 | O'Dowd | 246/413 |
| 946,952 | A | * | 1/1910 | Anderson | 246/401 |
| 1,169,106 | A | * | 1/1916 | Anderson | 246/411 |
| 1,320,522 | A | * | 11/1919 | Anderson | 246/411 |
| 1,373,406 | A | * | 4/1921 | Brown et al. | 246/404 |
| 1,485,966 | A | * | 3/1924 | Dixon | 246/452 |
| 1,499,251 | A | * | 6/1924 | Pickel | 246/411 |
| 1,563,563 | A | * | 12/1925 | Gerdes et al. | 246/452 |
| 1,677,356 | A | * | 7/1928 | McGarry | 246/411 |
| 1,908,781 | A | * | 5/1933 | Neeson | 246/405 |
| 2,009,269 | A | * | 7/1935 | Lundy | 403/74 |
| 2,041,382 | A | | 5/1936 | Strong | |
| 2,205,114 | A | * | 6/1940 | Bone | 246/253 |
| 2,208,449 | A | * | 7/1940 | Bone | 403/135 |
| 2,245,427 | A | | 6/1941 | Bone | |
| 2,712,914 | A | * | 7/1955 | Lavarack et al. | 246/452 |
| 3,363,097 | A | | 1/1968 | Wilhelm et al. | |
| 3,659,294 | A | | 5/1972 | Glabiszewski | |
| 4,093,163 | A | | 6/1978 | Larsson | |
| 4,637,579 | A | | 1/1987 | Hartung | |
| 5,620,156 | A | | 4/1997 | Berggren et al. | |

* cited by examiner

*Primary Examiner*—Mark T. Le
(74) *Attorney, Agent, or Firm*—Brij K. Agarwal; Eckert Seamans Cherin & Mellott, LLC

(57) ABSTRACT

An improved railroad switch apparatus includes a switch machine, a locking system lug, a detection system lug, a lock rod connecting rod, a point detector connecting rod, and a pair of movable rails. The locking system lug is mounted on a pair of lock rods of a switch machine, and the detection system lug is mounted on a point detector rod of the switch machine. The locking system lug includes a groove that receives the lock rod connecting rod and that permits a slight degree of pivoting therebetween while remaining securely mounted thereto. Similarly, the detection system lug includes a groove that receives the point detector connecting rod and that permits a slight degree of pivoting therebetween while remaining securely mounted thereto. The locking system lug and the detection system lug each include a pair of opposed convex retention surfaces formed on the groove thereof.

52 Claims, 6 Drawing Sheets

DROP DOWN LUG FOR RAILROAD SWITCH APPLICATION

BACKGROUND OF THE INVENTION

1. Field of the Invention

The present invention relates generally to railroad switch equipment and, more particularly, to a connection lug for use between a railroad switch machine and componentry extending to the movable tracks of a railroad switch.

2. Description of the Related Art

Numerous different types of railroad switch equipment are known and understood in the railroad arts. It is generally understood that a railroad switch apparatus is employed to switch a train from a first set of railroad tracks onto a second set of railroad tracks. Such a railroad switch apparatus typically includes a pair of movable rails and a switch machine, and additionally includes assorted connective hardware that extends between the movable rails and the switch machine for various purposes. The switch machine provides the forces necessary to move the movable rails between a first position and a second position and to lock the movable rails in the first and second positions.

It also known that railroad equipment including railroad switch apparatuses are typically subjected to extreme punishment due to the substantial forces and vibrations transmitted from passing railroad trains, as well as severe environmental conditions including heat, snow, and ice. Railroad equipment thus is configured generally to resist the effects of such harsh conditions, and rather to perform reliably under such conditions.

It is further known that railroad tracks and other related equipment extend across many remote regions, and that trains travel on such remote tracks at all hours of the day and night. As such, railroad personnel must be available to inspect and, if necessary, repair railroad equipment at numerous remote locations at any hour. The skill level of railroad maintenance personnel varies greatly. As such, railroad equipment typically is of a relatively simple configuration that can be repaired with a minimal number of tools in order to limit the number of potential points of failure of such railroad equipment and to facilitate repair by virtually any railroad personnel no matter the skill level or the quantity of tools available to such personnel.

In order to ensure the proper functioning of railroad switch apparatuses in all types of weather conditions and to resist breakage and maladjustment of such switch apparatuses, the connective hardware that extends between a switch machine and a pair of movable rails has typically included connecting rods that have been substantially rigidly connected with function rods that are part of the switch machine and that are movable with respect to other parts of the switch machine. While such rigid connections generally enhance the reliability of railroad switch apparatuses, such rigid connections nevertheless increase the difficulty and expense of installing and maintaining railroad equipment due to the degree of alignment that must be attained between the switch machine and the movable tracks.

During installation and replacement of previously known railroad switch apparatuses, special care was required to align the switch machine with the movable tracks in order to ensure that the connective hardware that would be rigidly connected between the switch machine and the movable tracks would be properly connected, and that such connective hardware would operate properly without the components thereof or the movable tracks binding during operation. Often such previously known switch machines were mounted onto the wooden ties to which the tracks were mounted, with the base of the switch machine needing to be aligned either flush with the lower surfaces of the tracks or at a given vertical distance from such lower surfaces. Such alignment typically was burdensome and costly to achieve during initial construction, and is particularly difficult and time consuming after repair or replacement of a switch machine due to the gradual deterioration of railroad ties and the difficulty of reliably employing such ties to align a switch machine with railroad tracks. It thus has been desired to provide an improved structure that facilitates installation of a switch machine and connection thereof with the movable tracks of a railroad switch apparatus while maintaining the necessary reliability and resistance to weather conditions of the switch apparatus.

SUMMARY OF THE INVENTION

A railroad switch apparatus and its lugs advantageously provides these and other benefits. An improved railroad switch apparatus includes a switch machine, a locking system lug, a detection system lug, a lock rod connecting rod, and a point detector connecting rod. The lock rod connecting rod and the point detector connecting rod are connected with a pair of movable rails of the railroad switch apparatus. The locking system lug is mounted on a pair of lock rods of the switch machine, and the detection system lug is mounted on a point detector rod of the switch machine. The locking system lug advantageously includes a groove that receives the lock rod connecting rod that permits the lock rod connecting rod to pivot slightly with respect to the locking system lug while remaining securely connected thereto. Similarly, the detection system lug includes a groove that receives the point detector connecting rod and that permits the point detector connecting rod to pivot somewhat with respect to the detection system lug while remaining securely mounted thereto. The locking system lug and the detection system lug each include a pair of opposed convex retention surfaces formed on the groove thereof.

Accordingly, an aspect of the present invention is to provide an improved lug that permits a connecting rod mounted thereon to pivot somewhat with respect thereto while remaining securely mounted thereon.

Another aspect of the present invention is to provide such a lug in the form of a locking system lug or a detection system lug that can be connected with a lock rod connecting rod or a point detector connecting rod, respectively.

Another aspect of the present invention is to provide an improved lug for use in a railroad switch apparatus, with the lug being formed to include a groove having a pair of opposed convex retention surfaces.

Another aspect of the present invention is to provide a locking system lug and a detection system lug that substantially alleviate the need for precise alignment of a switch machine with the rails of a railroad switch apparatus.

Another aspect of the present invention is to provide a railroad switch apparatus that is relatively easier to install and maintain than previously known railroad switch apparatuses.

Another aspect of the present invention is to provide an improved lug that can be retrofitted to existing railroad switch apparatuses.

Another aspect of the present invention is to provide an improved railroad switch apparatus including at least one of a locking system lug and a detection system lug that connect between a switch machine and connecting rod, with the lug permitting the connecting rod to pivot slightly with respect to the lug.

Accordingly, an aspect of the present invention is to provide a lug, the lug being structured to connect a function rod of a railroad switch machine with a connecting rod, the connecting rod being operatively connected with a movable railroad track, in which the general nature of the lug can be stated as including a first mount, the first mount being structured to be connected with the function rod, a second mount, the second mount being structured to be connected with the connecting rod, the lug being formed to include a slot, the second mount being disposed at least partially in the slot, the slot including at least a first retention surface, the at least first retention surface being convex, and the at least first retention surface being structured to engage the connecting rod.

Another aspect of the present invention is to provide a combination the general nature of which can be stated as including a connecting rod, the connecting rod being structured to be operatively connected with a movable railroad track, and a lug, the lug including a first mount, the first mount being structured to be connected with a function rod of a railroad switch machine, the lug including a second mount, the lug being formed to include a slot, the slot including at least a first retention surface, the at least first retention surface being convex, the second mount being disposed in the slot, the connecting rod being disposed on the second mount, and the connecting rod being pivotable with respect to the lug.

Another aspect of the present invention is to provide a combination, the general nature of which can be stated as including a connecting rod, the connecting rod being structured to be operatively connected with a movable railroad track, a function rod, the function rod being structured to be a component of a railroad switch machine, and a lug, the lug including a first mount, the function rod being attached to the first mount, the lug including a second mount, the connecting rod being disposed on the second mount, the lug being formed to include a slot, the slot including at least a first retention surface, the at least first retention surface being convex, and the second mount being disposed in the slot.

Another aspect of the present invention is to provide a combination, the general nature of which can be stated as including a connecting rod, the connecting rod being structured to be operatively connected with a movable railroad track, and a lug, the lug including a first mount, the first mount being structured to be connected with a function rod of a railroad switch machine, the lug including a second mount, the lug being formed to include a slot, the second mount being disposed in the slot, the slot including at least a first retention surface, the connecting rod including at least a first engagement surface, at least one of the at least first retention surface and the at least first engagement surface being convex, the connecting rod being disposed on the second mount, the at least first retention surface and the at least first engagement surface being engaged with one another, and the connecting rod being pivotable with respect to the lug.

Another aspect of the present invention is to provide a railroad switch apparatus, the general nature of which can be stated as including a switch machine, the switch machine including a function rod, at least a first movable rail, a connecting rod, the connecting rod and the at least first movable rail being operatively connected with one another, a lug, the function rod being connected with the lug, the connecting rod being connected with the lug, the lug including a first mount, the lug including a second mount, the lug being formed to include a slot, the second mount being disposed in the slot, the slot including at least a first retention surface, the connecting rod including at least a first engagement surface, at least one of the at least first retention surface and the at least first engagement surface being convex, the connecting rod being disposed on the second mount, the at least first retention surface and the at least first engagement surface being engaged with one another, and the connecting rod being pivotable with respect to the lug.

BRIEF DESCRIPTION OF THE DRAWINGS

A further understanding of the invention can be gained from the following description of the preferred embodiment when in read in conjunction with the accompanying drawings in which.

Similar numerals refer to similar parts throughout the specification.

DESCRIPTION OF THE PREFERRED EMBODIMENT

Figure 1:
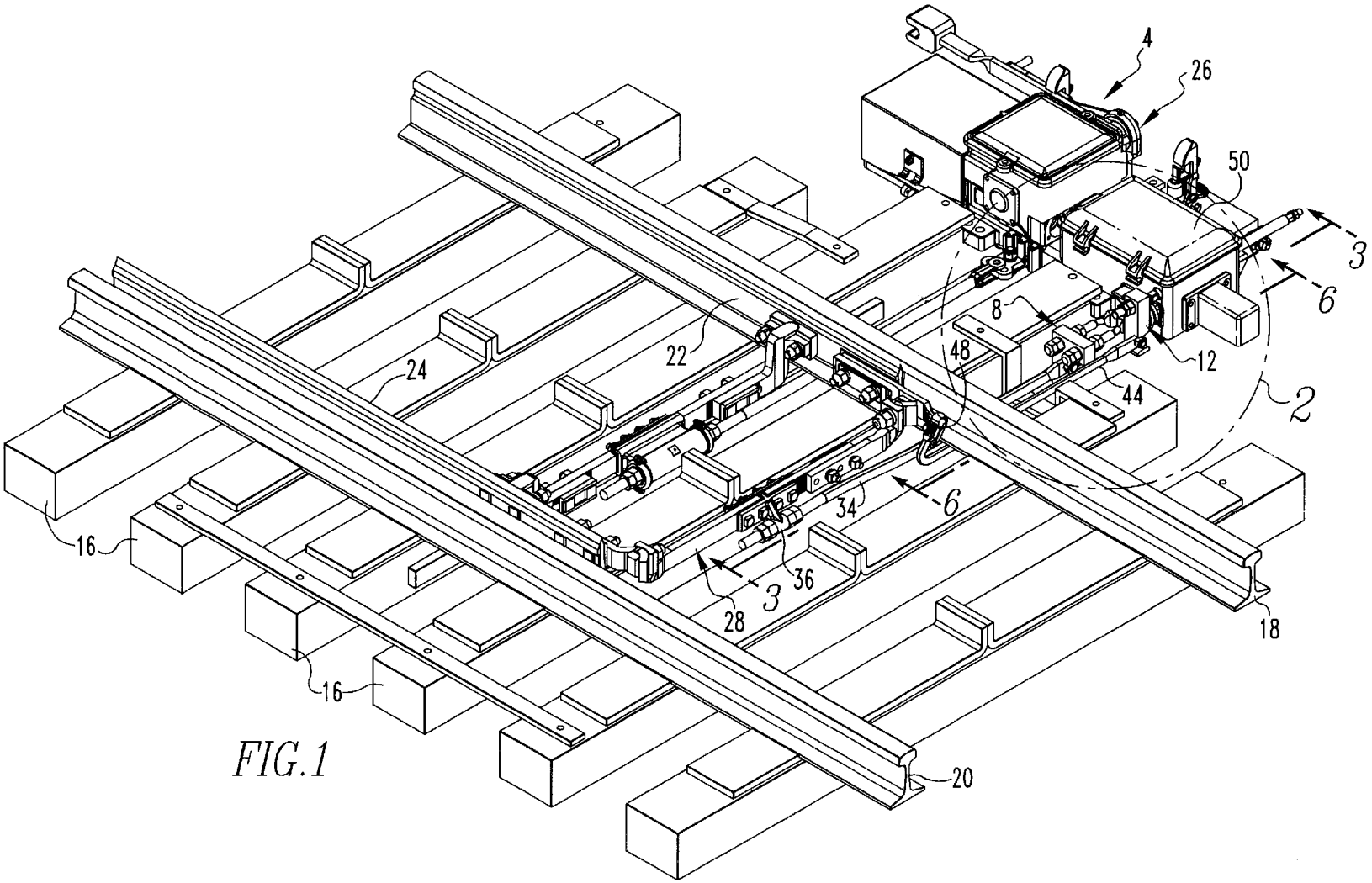
FIG. 1 is a perspective view of a railroad switch apparatus in accordance with the present invention.

A railroad switch apparatus 4 in accordance with the present invention is indicated generally in FIG. 1. As will be set forth more fully below, the railroad switch apparatus 4 advantageously includes a locking system lug 8 and a detection system lug 12, both in accordance with the present invention. The inclusion of the locking system lug 8 and the detection system lug 12 into the railroad switch apparatus 4 facilitates the initial assembly and installation as well as the repair and maintenance of the railroad switch apparatus 4.

The railroad switch apparatus 4 is employed in conjunction with a portion of a railroad track that is depicted in FIG. 1 as including a plurality of ties 16 and a pair stock rails 18 and 20 that are fixedly mounted on the ties 16. It is understood that an additional pair of stationary stock rails (not shown) extend generally away from the railroad switch apparatus 4 in addition to the stock rails 18 and 20.

The railroad switch apparatus 4 includes a pair of movable rails 22 and 24 that are operatively connected with a switch machine 26 and which are movable between a first position (FIG. 1) in which the movable rail 22 is engaged with the stock rail 18 and a second position (not shown) in which the movable rail 24 is engaged with the stock rail 20. Such alternate engagement of the movable rails 22 and 24 with the stock rails 18 and 20, respectively, according to the operation of the railroad switch apparatus 4 permits a train to be switched from one set of tracks onto to a second set of tracks according to known principles.

As can best be seen in FIG. 1, the railroad switch apparatus 4, in addition to the locking system lug 8 and the detection system lug 12, includes the switch machine 26, a front rod assembly 28, a lock rod connecting rod 34, a rod assembly connector 36, a point detector connecting rod 44, and a point connector 48. The front rod assembly 28 extends between the movable rails 22 and 24 and is connected to the lock rod connecting rod 34 with the rod assembly connector 36. Opposite the rod assembly connector 36 the lock rod connecting rod 34 is connected the locking system lug 8, as will be set forth more fully below.

The point detector connecting rod 34 is mounted on the point connector 48 which is, in turn, mounted on the movable rail 22. Opposite the movable rail 22 the point detector connecting rod 34 is connected with the detection system lug 12 as will be set forth more fully below.

Figure 2:
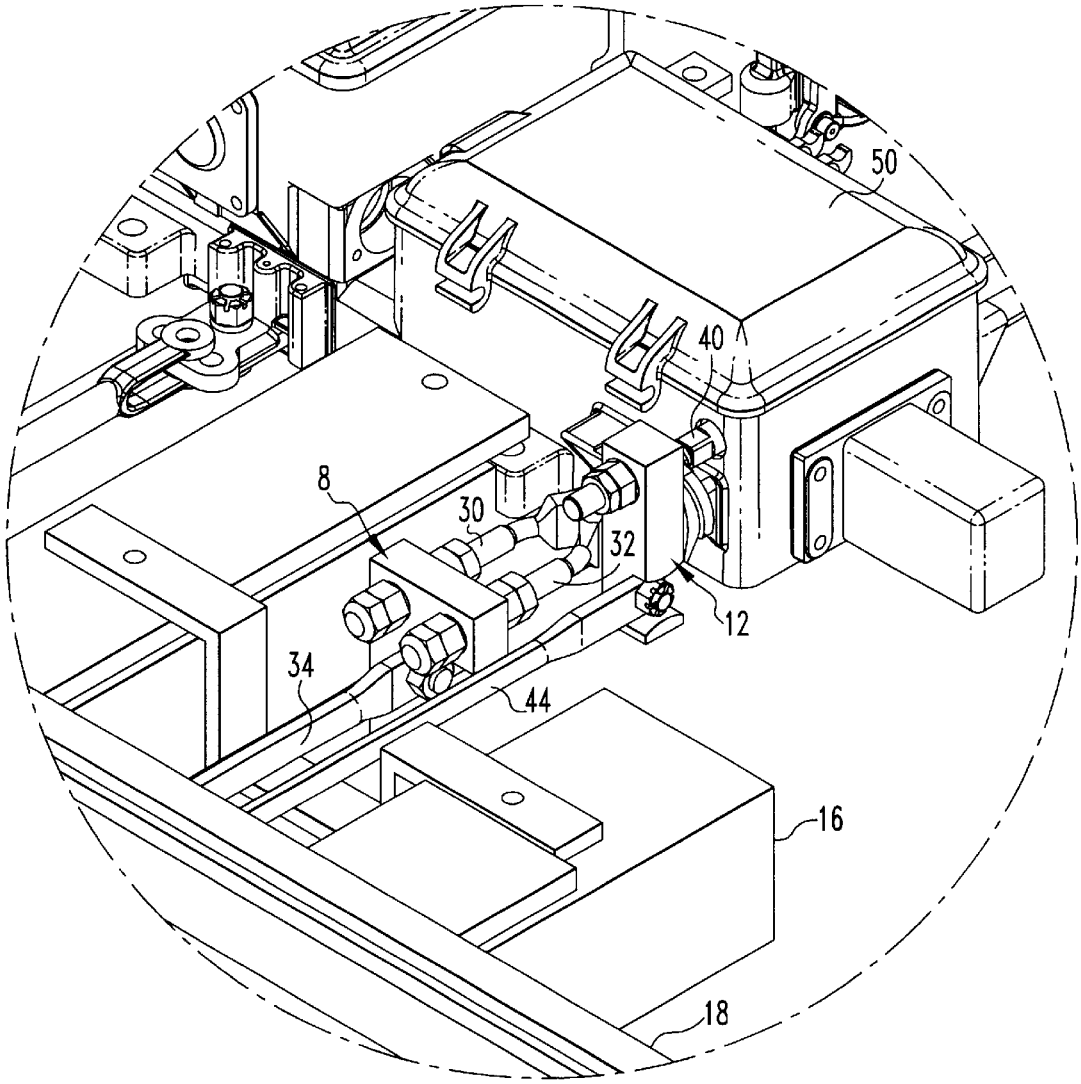
FIG. 2 is an enlarged view of a portion of FIG. 1.

As can be understood from FIG. 2, the switch machine 26 includes a housing 50, as well as a pair of lock rods 30 and 32 and a point detector rod 40 that are movable with respect to the housing 50 and that protrude outwardly from the housing 50. As will be set forth below in greater detail, the locking system lug 8 is mounted on the lock rods 30 and 32, and the detection system lug 12 is mounted on the point detector rod 40.

Figure 5:
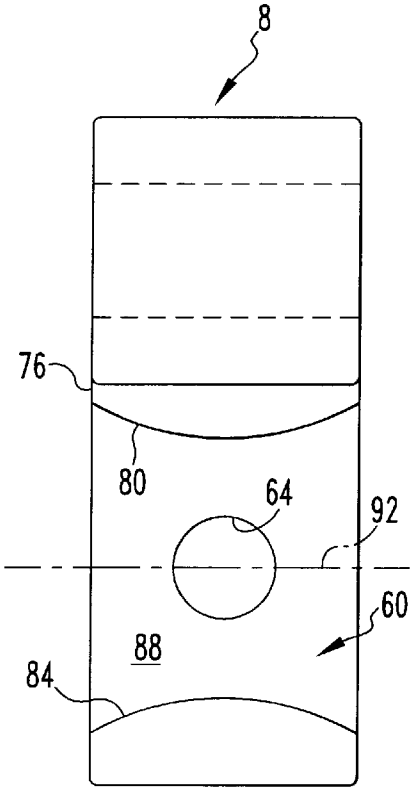
FIG. 5 is a right side elevational view of the locking system lug.
Figure 4:
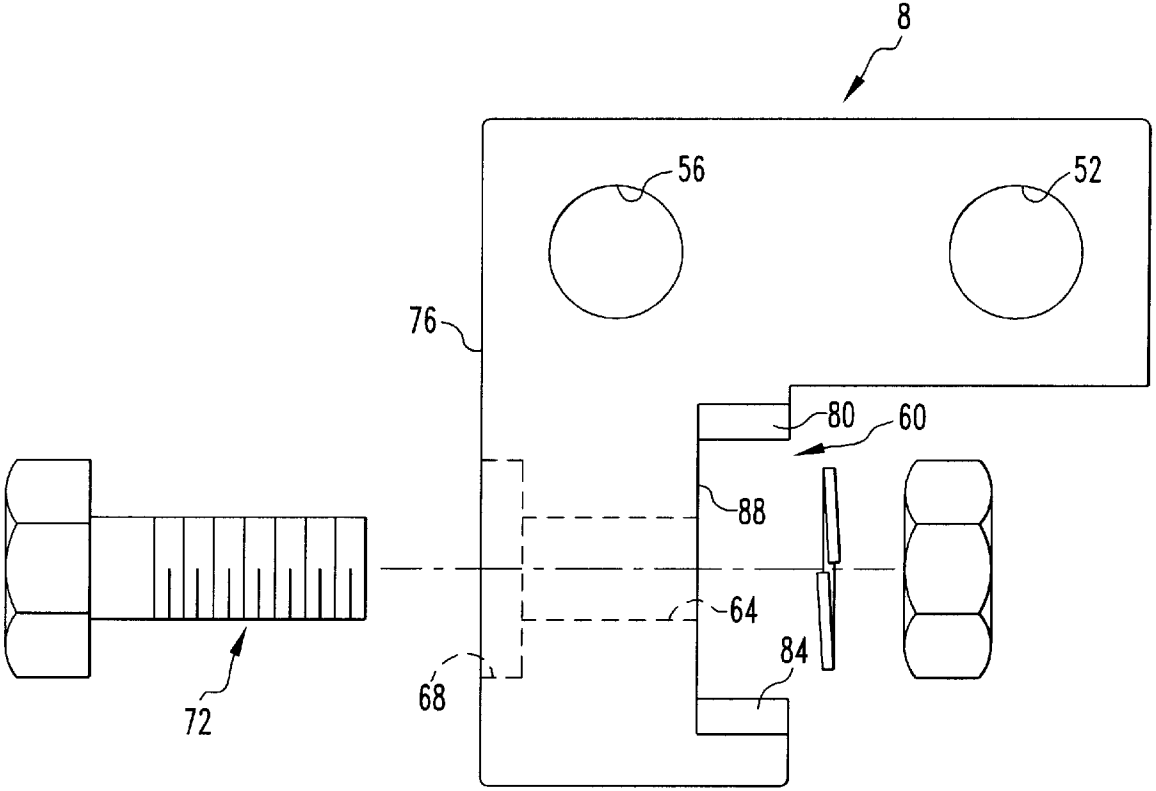
FIG. 4 is a front elevational view of a locking system lug of the railroad switch apparatus in accordance with the present invention.

As is best shown in FIGS. 4 and 5, the locking system lug 8 includes a pair of longitudinal mounting holes 52 and 56 extending therethrough, a groove 60, and a transverse mounting hole 64. It can be seen that the longitudinal mounting holes 52 and 56 are substantially parallel with one another and are substantially perpendicular to the transverse mounting hole 64. The transverse mounting hole 64 is in communication with the groove 60 and includes a counterbore 68 opposite the groove 60.

The locking system lug 8 further includes a fastener 72 which is depicted in FIG. 4 as being a bolt and a nut. It is understood, however, that the fastener 72 may be of other configurations that will be apparent to one skilled in the art without departing from the concept of the present invention. The longitudinal mounting holes 52 and 56 serve as a first mount for attaching other structures to the locking system lug 8, and the groove 60 serves as a second mount for attaching other structures thereto, as will be set forth more fully below. As can be best understood from FIG. 4, a shank 76 extends generally between the transverse mounting hole 64 and the pair of longitudinal mounting holes 52 and 56.

As can be further understood from FIGS. 4 and 5, the groove 60 includes a first retention surface 80, a second retention surface 84, and an abutment surface 88. The first and second retention surfaces 80 and 84 are generally convex, with the convex curvatures of the first and second retention surfaces 80 and 84 being generally opposite one another. The abutment surface 88 is generally planar and extends between the first and second retention surfaces 80 and 84.

As used herein, the term "convex" and variations thereof shall refer to a surface that is generally arcuate in shape and that may or may not be of a fixed radius. The first and second retention surfaces 80 and 84 of the locking system lug 8 depicted generally in FIG. 5 each are of a fixed radius of approximately 2.0 inches, although it is understood that such concave surfaces can be of other radiuses, both fixed and non-fixed.

Figure 3:
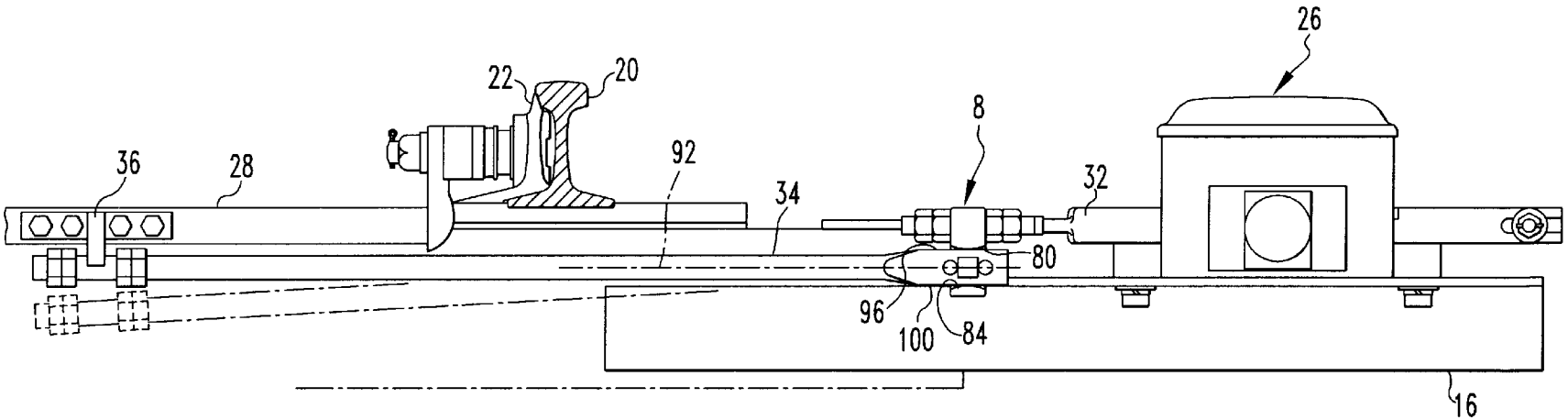
FIG. 3 is a sectional view as taken along line 3—3 of FIG. 1.

As can be understood from FIG. 3, the end of the lock rod connecting rod 34 opposite the rod assembly connector 36 is receivable in the groove 60 and includes a hole through which the fastener 72 can be received for securely attaching the lock rod connecting rod 34 to the locking system lug 8. It can be seen that the lock rod connecting rod 34 includes a first engagement surface 96 and a second engagement surface 100 that are both substantially planar in configuration and are parallel and spaced from one another. In the embodiment of the present invention depicted generally in FIG. 3, the first and second engagement surfaces 96 and 100 are in contact with the first and second retention surfaces 80 and 84, respectively. It is understood, however, that in other embodiments of the present invention the first and second engagement surfaces 96 and 100 may not be in contact with both of the first and second retention surfaces 80 and 84 at all times.

As can be understood from FIG. 3, when the lock rod connecting rod 34 is mounted in the groove 60, i.e., the second mount, the lock rod connecting rod 34 is at least slightly pivotable with respect to the locking system lug 8 as is indicated by the depiction in FIG. 3 of the lock rod connecting rod 34 in a second position in phantom lines. The lock rod connecting rod 34 can pivot upwardly a substantially equal distance as that depicted downwardly by the phantom lines.

The lock rod connecting rod 34 is engaged substantially at all times with the abutment surface 88 when disposed within the groove 60 and fastened by the fastener 72. The fastener 72 cooperating with the abutment surface 88, along with the first and second retention surfaces 80 and 84 securely retain the lock rod connecting rod 34 within the groove 60 of the locking system lug 8, yet permit the lock rod connecting rod 34 to pivot with respect to the locking system lug 8. In this regard, it can be seen that the groove 60 includes a groove axis 92 that extends generally parallel with the lock rod connecting rod 34 toward the rod assembly connector 36. Since the lock rod connecting rod 34 is pivotable with respect to the locking system lug 8, it can be seen that the groove axis 92 similarly can be of correspondingly pivoted positions with respect to the groove 60, it being understood, however, that the groove axis 92 extends generally to the rod assembly connector 36, i.e., the point of connection between the lock rod connecting rod 34 and the front rod assembly 28. Further in this regard, it can be seen that the groove axis 92 substantially always extends generally in a direction between the switch machine 26 and the rod assembly connector 36.

As can be understood from FIG. 3, by permitting the lock rod connecting rod 34 to pivot with respect to the locking system lug 8, while remaining securely connected thereto, the switch machine 26 can be mounted at variety of vertical heights with respect to the stock rails 18 and 20 and the movable rails 22 and 24 without negatively impacting the performance of the railroad switch apparatus 4, such as by binding of any parts of the railroad switch apparatus 4 or by failure to enable connection and assembly of the various components of the railroad switch assembly 4.

As can be understood from FIGS. 2 and 3, the lock rods 30 and 32 each include a threaded stud that extends through the longitudinal mounting holes 52 and 56 and that receive nuts thereon for rigidly fastening the locking system lug 8 onto the lock rods 30 and 32. Such attachment is to the first mount, as discussed above, of the locking system lug 8. It thus can be seen that the locking system lug 8 includes both a rigid connection, i.e., with the switch machine 26, as well as a pivotable, adjustable, or movable connection, i.e., with the lock rod connecting rod 34 and thus with the movable rails 22 and 24. Such adjustability substantially overcomes the need to precisely position the switch machine 26 at a specific vertical location with respect to the stock rails 18 and 20 and the movable rails 22 and 24, which advantageously facilitates installation, repair, and maintenance of the railroad switch apparatus 4.

Figure 6:
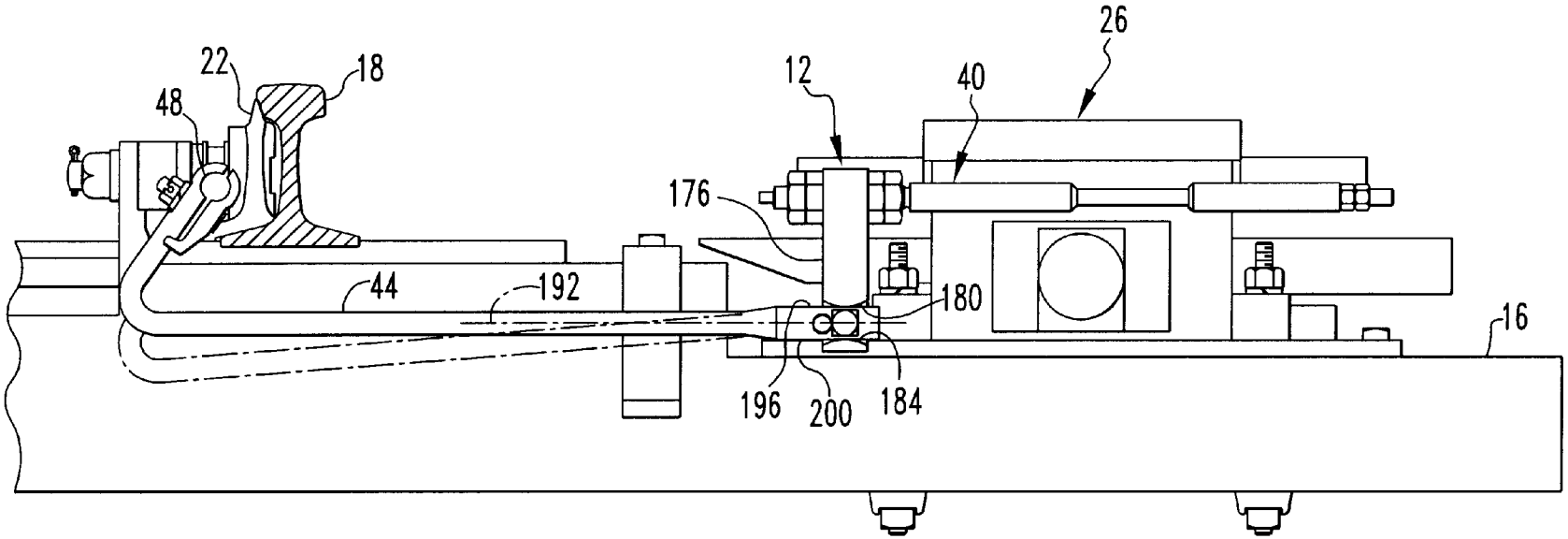
FIG. 6 is a sectional view as taken along line 6—6 of FIG. 1.
Figure 8:
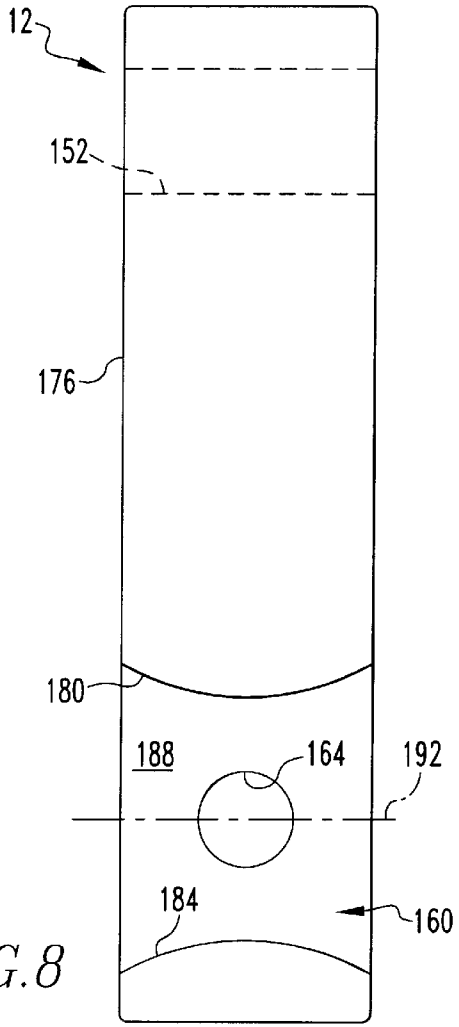
FIG. 8 is a right side elevational view of the detection system lug.
Figure 7:
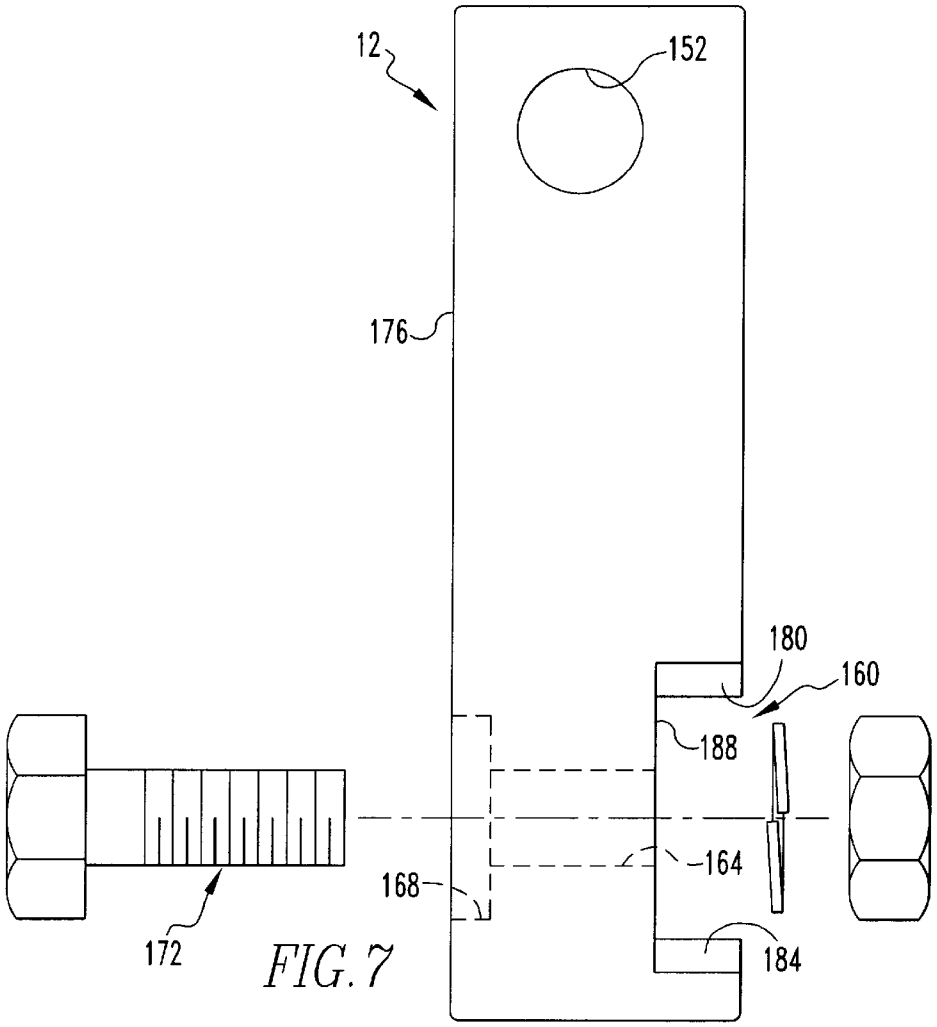
FIG. 7 is a front elevational view of a detection system lug of the railroad switch apparatus in accordance with the present invention.

As can be understood from FIGS. 6–8, the detection system lug 12 includes a longitudinal mounting hole 152, a groove 160, and a transverse mounting hole 164. The transverse mounting hole 164 is oriented substantially perpendicular to the longitudinal mounting hole 152 and includes a counterbore 168. The detection system lug 12 further includes a fastener 12 which is depicted in FIG. 7 as being bolt and nut, although other attachment methodologies will be apparent to those skilled in the art.

It can be seen that the groove 160 includes first and second retention surfaces 180 and 184 as well as an abutment surface 188. The first and second retention surfaces 180 and 184 are convex in configuration and disposed generally opposite one another. The abutment surface 188 extends generally between the first and second retention surfaces 180 and 184. It can be seen that the detection system lug 12 includes a shank 176 extending generally between the transverse mounting hole 164 and the longitudinal mounting hole 152.

As can be understood from FIG. 6, the point detector connector rod 44 includes a first engagement surface 196 and a second engagement surface 200 that are each substantially planar in configuration and are substantially parallel and spaced apart from one another. It can further be understood from FIG. 3 that the point detector connecting rod 44 can be received in the groove 160 and can be securely mounted to the detection system lug 12 with the fastener 172. Despite such secure attachment, however, the point detector connecting rod 44 is slightly pivotable with respect to the detection system lug 12.

In a fashion similar to the locking system lug 8, the detection system lug 12 provides both a substantially rigid connection as well as a secure but slightly movable connection. Specifically, the point detector rod 40 includes a threaded stud that is received in the longitudinal mounting hole 152 and additionally receives nuts thereon for substantially rigidly connecting the detection system lug 12 onto the point detector rod 40. Such connection is accordingly via a first mount of the detection system lug 12.

Opposite the longitudinal mounting hole 152, a second mount of the detection system lug 12 at the groove 160 permits the point detector connecting rod 44 to pivot, move, and adjust slightly with respect to the detection system lug 12 despite the secure engagement of point detector connecting rod 44 to the abutment surface 188 when the fastener 172 is fastened. The first and second engagement surfaces 196 and 200 are generally in contact with the first and second retention surfaces 180 and 184, although in to her embodiments (not depicted herein) the first and second engagement surfaces 196 and 200 may not be engaged or in contact with both of the first and second retention surfaces 180 and 184 at all times. It is understood that the engagement of the point detector connecting rod 44 with the abutment surface 188, along with the first and second retention surfaces 180 and 184 securely retains the point detector connecting rod 44 on the detection system lug 12 while permitting a degree of movement therebetween.

It thus can be seen that such movement, in a fashion similar to that provided by the locking system lug 8, permits the switch machine 26 to be mounted at a variety of vertical positions with respect to the stock rails 18 and 20 and the movable rails 22 and 24, which facilitates installation, repair, and maintenance of the railroad switch apparatus 4, and further promotes reliable operation thereof by resisting binding of the components of the railroad switch apparatus 4. The groove 60 similarly includes a groove axis 192 that is variable with the specific position of the point detector connecting rod 44 and that generally always extends between the switch machine 26 and the point connector 48, it being understood that the point detector connecting rod 44 includes a curved leg that connects with the point connector 48 and thus spaces the groove axis 192 from the specific connection of the point detector connecting rod 44 with the point connector 48.

Based on the foregoing, therefore, it can be seen that by providing the locking system lug 8 and the detection system lug 12 with grooves 60 and 160 having convex first and second retention surfaces 80, 84, 180, 184, the switch machine 26 need not be precisely vertically aligned with the stock rails 18 and 20 and the movable rails 22 and 24, but rather can be positioned within a range of vertical locations, which facilitates installation, repair, and maintenance of the railroad switch apparatus 4. The locking system lug 8 and the detection system lug 12, as indicated above, advantageously each provide both a first mount and a second mount that provides a substantially rigid attachment and a secure yet pivotable attachment, respectively, thereto.

While a specific embodiment of the invention has been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. A lug, the lug being structured to connect a function rod of a railroad switch machine with a connecting rod, the connecting rod being operatively connected with a movable railroad track, the lug comprising:

a first mount;

the first mount being structured to be connected with the function rod;

a second mount;

the second mount being structured to be connected with the connecting rod;

the lug being formed to include a slot;

the second mount being disposed at least partially in the slot;

the slot including at least a first retention surface;

the at least first retention surface being convex; and the at least first retention surface being structured to engage the connecting rod.

2. The lug as set forth in claim 1, in which the slot includes a second retention surface;

the second retention surface being convex.

3. The lug as set forth in claim 2, in which the at least first and second retention surfaces are opposed to one another.

4. The lug as set forth in claim 2, in which the second mount is disposed between the at least first and second retention surfaces.

5. The lug as set forth in claim 2, in which the second mount includes a fastener;

the fastener being disposed between the at least first and second retention surfaces.

6. The lug as set forth in claim 5, in which the fastener is a bolt.

7. The lug as set forth in claim 5, in which the first mount is a first mounting hole;

the first mounting hole being structured to receive at least a portion of the function rod therein.

8. The lug as set forth in claim 1, in which the lug includes a shank;

the shank extending between the first and second mounts.

9. The combination comprising:

a connecting rod;

the connecting rod being structured to be operatively connected with a movable railroad track; and a lug;

the lug including a first mount;

the first mount being structured to be connected with a function rod of a railroad switch machine;

the lug including a second mount;

the lug being formed to include a slot;

the slot including at least a first retention surface;

the at least first retention surface being convex;

the second mount being disposed in the slot;

the connecting rod being disposed on the second mount; and the connecting rod being pivotable with respect to the lug.

10. The combination as set forth in claim 9, in which the slot includes a second retention surface;

the second retention surface being convex.

11. The combination as set forth in claim 10, in which the at least first and second retention surfaces are opposed to one another.

12. The combination as set forth in claim, 11 in which the second mount is disposed between the at least first and second retention surfaces.

13. The combination as set forth in claim 12, in which the second mount includes a fastener;

the fastener being disposed between the at least first and second retention surfaces.

14. The combination as set forth in claim 13, in which the fastener is a bolt.

15. The combination as set forth in claim 10, in which the slot includes an abutment surface;

the abutment surface extending between the at least first and second retention surfaces;

the abutment surface being substantially planar;

the connection rod being engaged with the abutment surface.

16. The combination as set forth in claim 10, in which the connecting rod is in contact with both of the at least first and second retention surfaces.

17. The combination as set forth in claim 9, in which the connecting rod is a lock rod connecting rod;

the first mount being structured to be connected with a lock rod of a railroad switch machine.

18. The combination as set forth in claim 9, in which the connecting rod is a point detector rod connecting rod;

the first mount being structured to be connected with a point detector rod of a railroad switch machine.

19. The combination as set forth in claim 9, in which the connecting rod is in contact with the at least first retention surface.

20. The combination as set forth in claim 19, in which the connecting rod remains in contact with the at least first retention surface during pivoting of the connecting rod with respect to the lug.

21. The combination as set forth in claim 9, in which the connecting rod includes at least a first engagement surface;

the at least first engagement surface being substantially planar;

the at least first engagement surface being engaged with the at least first retention surface.

22. The combination as set forth in claim 21, in which the at least first engagement surface remains engaged with the at least first retention surface during pivoting of the connecting rod with respect to the lug.

23. The combination as set forth in claim 21, in which the slot includes a second retention surface;

the second retention surface being convex;

the connecting rod including a second engagement surface;

the second engagement surface being substantially planar;

the second engagement surface being engaged with the second retention surface.

24. The combination as set forth in claim 23, in which the at least first and second engagement surfaces are substantially parallel.

25. The combination as set forth in claim 9, in which the lug includes a shank;

the shank extending between the first and second mounts.

26. The combination comprising:

a connecting rod;

the connecting rod being structured to be operatively connected with a movable railroad track;

a function rod;

the function rod being structured to be a component of a railroad switch machine; and a lug;

the lug including a first mount;

the function rod being attached to the first mount;

the lug including a second mount;

the connecting rod being disposed on the second mount;

the lug being formed to include a slot;

the slot including at least a first retention surface;

the at least first retention surface being convex; and the second mount being disposed in the slot.

27. The combination as set forth in claim 26, in which the slot includes a second retention surface;

the second retention surface being convex;

the at least first and second retention surfaces being opposed to one another; and the second mount being disposed between the at least first and second retention surfaces.

28. The combination as set forth in claim 26, in which the connecting rod is pivotable with respect to the lug.

29. The combination as set forth in claim 28, in which the function rod is substantially rigidly connected with the lug.

30. The combination as set forth in claim 26, in which the connecting rod is in contact with the at least first retention surface.

31. The combination as set forth in claim 30,
in which the connecting rod remains in contact with the at least first retention surface during pivoting of the connecting rod with respect to the lug.

32. The combination as set forth in claim 26,
in which the connecting rod is a lock rod connecting rod;
the function rod being a lock rod of a railroad switch machine.

33. The combination as set forth in claim 26,
in which the connecting rod is a point detector rod connecting rod;
the function rod being a point detector rod of a railroad switch machine.

34. The combination as set forth in claim 26,
in which the lug includes a shank;
the shank extending between the first and second mounts.

35. The combination comprising:
a connecting rod;
the connecting rod being structured to be operatively connected with a movable railroad track; and
a lug;
the lug including a first mount;
the first mount being structured to be connected with a function rod of a railroad switch machine;
the lug including a second mount;
the lug being formed to include a slot;
the second mount being disposed in the slot;
the slot including at least a first retention surface;
the connecting rod including at least a first engagement surface;
at least one of the at least first retention surface and the at least first engagement surface being convex;
the connecting rod being disposed on the second mount;
the at least first retention surface and the at least first engagement surface being engaged with one another; and
the connecting rod being pivotable with respect to the lug.

36. The combination as set forth in claim 35,
in which the second mount includes a fastener;
the fastener being disposed in the slot.

37. The combination as set forth in claim 36,
in which the fastener is a bolt.

38. The combination as set forth in claim 35,
in which the slot includes an abutment surface;
the abutment surface being substantially planar;
the connection rod being engaged with the abutment surface.

39. The combination as set forth in claim 35,
in which the connecting rod is a lock rod connecting rod;
the first mount being structured to be connected with a lock rod of a railroad switch machine.

40. The combination as set forth in claim 35,
in which the connecting rod is a point detector rod connecting rod;
the first mount being structured to be connected with a point detector rod of a railroad switch machine.

41. The combination as set forth in claim 35,
in which the at least first engagement surface remains engaged with the at least first retention surface during pivoting of the connecting rod with respect to the lug.

42. The combination as set forth in claim 35,
in which the lug includes a shank;
the shank extending between the first and second mounts.

43. A railroad switch apparatus comprising:
a switch machine;
the switch machine including a function rod;
at least a first movable rail;
a connecting rod;
the connecting rod and the at least first movable rail being operatively connected with one another;
a lug;
the function rod being connected with the lug;
the connecting rod being connected with the lug;
the lug including a first mount;
the lug including a second mount;
the lug being formed to include a slot;
the second mount being disposed in the slot;
the slot including at least a first retention surface;
the connecting rod including at least a first engagement surface;
at least one of the at least first retention surface and the at least first engagement surface being convex;
the connecting rod being disposed on the second mount;
the at least first retention surface and the at least first engagement surface being engaged with one another; and
the connecting rod being pivotable with respect to the lug.

44. The railroad switch apparatus as set forth in claim 43,
in which the second mount includes a fastener;
the fastener being disposed in the slot.

45. The railroad switch apparatus as set forth in claim 44,
in which the fastener is a bolt.

46. The railroad switch apparatus as set forth in claim 43,
in which the slot includes an abutment surface;
the abutment surface being substantially planar;
the connection rod being engaged with the abutment surface.

47. The railroad switch apparatus as set forth in claim 43,
in which the connecting rod is a lock rod connecting rod;
the function rod being a first lock rod.

48. The railroad switch apparatus as set forth in claim 47,
in which the first mount includes at least a first mounting hole;
the first lock rod being at least partially received in the at least first mounting hole.

49. The railroad switch apparatus as set forth in claim 48,
in which the first mount includes a second mounting hole;
the function rod including a second lock rod;
the second lock rod being at least partially received in the second mounting hole.

50. The railroad switch apparatus as set forth in claim 43,
in which the connecting rod is a point detector rod connecting rod;
the function rod being a point detector rod.

51. The railroad switch apparatus as set forth in claim 43,
in which the at least first engagement surface remains engaged with the at least first retention surface during pivoting of the connecting rod with respect to the lug.

52. The railroad switch apparatus as set forth in claim 43,
in which the lug includes a shank;
the shank extending between the first and second mounts.

* * * * *